US007638192B2

(12) United States Patent
Murphy et al.

(10) Patent No.: US 7,638,192 B2
(45) Date of Patent: Dec. 29, 2009

(54) OPEN FLAME RESISTANT ARTICLES

(75) Inventors: Harrison Robert Murphy, Great Falls, VA (US); Juraj Michal Daniel Slavik, II, McLean, VA (US)

(73) Assignee: Kickballs Concepts, LLC, Great Falls, VA (US)

( * ) Notice: Subject to any disclaimer, the term of this patent is extended or adjusted under 35 U.S.C. 154(b) by 143 days.

(21) Appl. No.: 12/023,348

(22) Filed: Jan. 31, 2008

(65) Prior Publication Data

US 2008/0149903 A1 Jun. 26, 2008

Related U.S. Application Data

(62) Division of application No. 10/956,943, filed on Oct. 1, 2004, now Pat. No. 7,365,033.

(60) Provisional application No. 60/528,255, filed on Dec. 9, 2003, provisional application No. 60/508,043, filed on Oct. 2, 2003.

(51) Int. Cl.

| | |
|---|---|
| ***D02G 3/02*** | (2006.01) |
| ***D02G 3/04*** | (2006.01) |
| ***D02G 3/18*** | (2006.01) |
| ***D03D 15/00*** | (2006.01) |

(52) U.S. Cl. ..... 428/364; 428/359; 428/920; 428/921; 442/189; 442/190; 442/197; 442/198

(58) Field of Classification Search ..... 428/359, 428/364, 920, 921; 442/189, 190, 197, 198
See application file for complete search history.

(56) References Cited

U.S. PATENT DOCUMENTS

| | | | | |
|---|---|---|---|---|
| 2004/0060119 | A1 * | 4/2004 | Murphy et al. | 5/698 |
| 2004/0060120 | A1 * | 4/2004 | Murphy et al. | 5/698 |
| 2004/0062912 | A1 * | 4/2004 | Mason et al. | 428/139 |
| 2004/0097156 | A1 * | 5/2004 | McGuire et al. | 442/361 |
| 2004/0102112 | A1 * | 5/2004 | McGuire et al. | 442/59 |
| 2004/0106347 | A1 * | 6/2004 | McGuire et al. | 442/361 |
| 2004/0226100 | A1 * | 11/2004 | Small et al. | 5/698 |
| 2005/0025962 | A1 * | 2/2005 | Zhu et al. | 428/359 |

FOREIGN PATENT DOCUMENTS

WO WO 03023108 A1 * 3/2003

* cited by examiner

*Primary Examiner*—Jenna-Leigh Johnson
(74) *Attorney, Agent, or Firm*—Heslin Rothenberg Farley & Mesiti P.C.

(57) ABSTRACT

Mattress and home furnishing items are made open flame resistant by a fire barrier fabric that includes chlorine-free rayon fiber. The fire barrier fabric at least partially encloses the core of the open flame resistant mattress or home furnishing item. When tested in accordance with the flame resistance test protocols of NFPA 267 or ASTM E 1590, the mattress has a maximum heat release rate of less than 250 kW and a total energy release of less than 40 MJ in the first five minutes of the test. The home furnishing items may be tested under test protocols such as California Technical Bulletin #604 or #117. TEQ of the products of the combustion of chlorine-free fibers, yarns and fabrics is less than or equal to 2 nanograms.

5 Claims, 2 Drawing Sheets

OPEN FLAME RESISTANT ARTICLES

CROSS REFERENCE TO RELATED APPLICATIONS

This application is a divisional U.S. application Ser. No. 10/956,943, filed Oct. 1, 2004, which was allowed as U.S. Pat. No. 7,365,033 on Apr. 29, 2008 and which claims benefit from U.S. provisional applications, Ser. No. 60/508,043, filed on Oct. 2, 2003, and Ser. No. 60/528,255, filed on Dec. 9, 2003, the entire disclosures of the foregoing are incorporated herein by reference.

BACKGROUND OF THE INVENTION

The importance of preventing fires in institutional settings has been recognized for many years, and a number of standards for flame retardance of mattresses and furniture have been promulgated.

A federal performance standard applicable to mattresses on a nationwide basis is codified in 16 CFR Part 1632 (Standard for Flammability of Mattresses and Mattress Pads), customarily referred to as the Cigarette Ignition Standard, the entire contents of which are incorporated herein by reference. However, even when mattresses meet the requirements of the Cigarette Ignition Standard, these can react with volatile and potentially deadly results when exposed to open-flame and smoldering ignition sources. The result can be a fire with sufficient energy to cause an average size room to reach a state of total instantaneous combustion or flashover. The California Bureau of Home Furnishings and Thermal Insulation has addressed the hazards associated with the ignition of mattresses in public institutions with California Technical Bulletin #129—Flammability Test Procedure for Mattresses for Use in Public Buildings (hereinafter 'TB 129'), published in October 1992. It has since been adopted as a voluntary consensus standard by the American Society of Testing and Materials as ASTM E-1590 and the National Fire Protection Association (NFPA) as NFPA 267. (ASTM E-1590 and NFPA 267 use essentially the same test protocol as TB 129 but contain no failure criteria.) The standard has also been embodied in NFPA 101® Life Safety Code® 2000 and 2003 editions, section 10.3.4, and in Underwriter's Laboratories' UL 1895.

At the time that the U.S. Consumer Product Safety Commission (CPSC) was engaged in the review of mattress flammability that resulted in the 16 CFR Part 1632, it also conducted reviews of fire hazards posed by upholstered furniture. To stave off federal regulation, the furniture industry voluntarily formed UFAC—the Upholstered Furniture Action Council—in 1978, to allow upholstered furniture manufacturers the opportunity to work with CPSC to design safety standards that were effective, economical and workable from a manufacturing standpoint. The UFAC program is intended to make upholstered furniture more resistant to ignition from smoldering cigarettes that are the leading cause of upholstery fires in the home. The California Bureau of Home Furnishings and Thermal Insulation has addressed the hazards associated with the ignition of upholstered furniture in public institutions with California Technical Bulletin #133—Flammability Test Procedure for Seating Furniture for Use in Public Occupancies (hereinafter 'TB 133'), published in January 1991. It has since been adopted as a voluntary consensus standard by the American Society of Testing and Materials as ASTM E-1537 and the National Fire Protection Association (NFPA) as NFPA 266. (ASTM E-1537 and NFPA 266 use essentially the same test protocol as TB 133 but contain no failure criteria.) The standard has also been embodied in NFPA 101® Life Safety Code® 2000 and 2003 editions, section 10.3.3.

Although hazards in public institutions have been addressed with standards based on TB 129 and TB 133, the number of injuries and fatalities associated with residential fires in which a mattress or upholstered furniture item was the first item ignited or the mattress exacerbated the fire event has led to efforts to reduce flammability of mattresses used in homes. One notable event is the passage of Assembly Bill 603 in the California Legislature of Assembly. The bill called for virtually all mattresses and sleep surfaces sold in the State of California, as of Jan. 1, 2004, to meet an open flame resistance standard and authorized BHFTI to take such steps as necessary to support the law. BHFTI published for comment in February 2003, California Technical Bulletin #603 (hereinafter 'TB 603'), and subsequent to a mandated comment period and review of received comments announced TB 603's regulatory parameters as an amendment to Section 1371 in Title 4: California Code of Regulations. BHFTI also announced that TB603 implementation and enforcement would commence on Jan. 1, 2005. In addition, the Consumer Products Safety Commission is currently developing new regulations for further reducing mattress flammability beyond the level required by the Cigarette Ignition Standards. This was announced recently in the Federal Register (Advance Notice of Public Rule Making (ANPR) published Oct. 11, 2001)) The CPSC has also been engaged for nearly a decade in development of enhanced regulatory measures designed to reduce the flammability of upholstered furniture items.

The examination of mattress flammability has also resulted in concurrent evaluation of the flammability of bedclothes articles—specifically filled bedding articles, such as pillows, mattress pads and comforters. In California, the work to develop standards to regulate the flammability of these items has resulted in the formulation of Technical Bulletin #604. It is believed that the CPSC work on mattresses will follow this path as well and ultimately lead to some regulation of filled bedding articles on the national/federal level as well.

New standards for flammability of residential mattresses will require new materials and methods of manufacturing these, as mattresses targeted for residential markets differ significantly from those typically used in institutions. Institutional bedding installations typically require only a mattress and no foundation; mattress may be simply a solid core of polyurethane foam, which may be combustion modified to some degree as well. Many of the components used in institutional mattresses and sleep support surfaces, as well as furniture items, including fill materials and covering fabrics are subject to performance testing according to test criteria such as NFPA 701 and California Technical Bulletin No. 117.

One approach to reducing flammability of mattresses and upholstered furniture has been to treat fabrics used in their construction with chemical flame-retardants. However, these chemical treatments may be objectionable because of distasteful odors which are noticeable when in close contact with the materials, off-gassing obnoxious elements, stiffness of the fabric caused by such treatments, which may compromise the comfort of the finished mattress, mattress foundation or furniture item, and the potential temporary durability of such treatments, which may compromise the long term protection from open-flame, smoldering ignition and radiant/thermal heat flux sources.

Since 1993, widely used approaches to reducing the flammability of institutional mattresses and furniture articles have employed tubular knitted fabrics comprised of blends of modacrylic and fiberglass fibers as a fire barrier sleeve or sock that encapsulates the internal fuel load of the mattress and attempts to isolate it from the ignition source. Commercial offerings such as INTEGRITY30™ Fire Barrier Fabric by Ventex, Inc. of Great Falls, Va., KI-163™ FireGard® Fabric as manufactured by Chiquola Fabrics LLC of Tennessee and BlazeBlocker™ Fire Barrier Fabric sold by Herculite Products of Emigsville, Pa. are exemplary of such offerings.

Other approaches to achieving open flame resistant performance for mattresses and furniture typically incorporate fabric barriers comprised of fibers that are flame retardant in nature and that usually include modacrylic or pre-oxidized acrylonitrile (PAN) in the blend. AKTIV™ Fire Barrier Fabric is a needlepunched non-woven fiberglass and modacrylic blend manufactured by BGF industries and offered for sale by Ventex, Inc since 1996. Yet another offering is Barrier-F™ Thermal Insulating Fabric, manufactured and offered for sale by Ventex, Inc. a blend of modacrylic and FR-viscose rayon that may offer full scale, open-flame resistant performance in mattress only constructions and sets of bedding that represent relatively simple protective challenges. Leggett and Platt has offered its Pyrogon™ non-woven that includes PAN fibers as a key ingredient and offered this product for sale to mattress manufacturers and other producers of articles that are seeking enhanced levels of open flame resistant performance.

The versatility of these fabric fire barriers may permit them to be utilized as barriers to open flame ignition sources in a wide range of composite articles, including, but not limited to, mattresses, mattress foundations, sets comprised of mattresses and mattress foundations, upholstered furniture articles, filled bedding articles, such as pillows, mattress pads, and comforters, wheelchair cushions, healthcare positioners, and transportation seating.

In many end-product applications throughout the world, products ranging from mattresses to furniture to protective apparel to name a few, have selected modacrylic fibers, PAN fibers or chlorofibre/vinyon/PVC—based fibers as preferred ingredients in the design of barriers and protective components intended to isolate the end-products from the hazards of open-flame and smoldering ignition.

Recent public attention has been drawn to the hazards associated with the by-products of combustive activity. Notably targets of these activities are the products that contain chlorine or chlorine by-products and that when subjected to combustion and thermal decomposition, release toxic substances, including, but not limited to, dioxins and chlorinated dibenzofurans.

Dioxin represents a group of chemicals that includes furan and biphenyl compounds that are toxic waste byproducts of the burning of chlorinated waste and manufacture of other organic chemicals that contain chlorine, and which in itself has no commercial or industrial use (Courture, L. et al., 1990. A Critical Review of the Developmental Toxicity and Teratogenicity of 2,3,7,8-Tetrachlorodibenzo-p-Dioxin: Recent Advances Toward Understanding the Mechanism. Teratology 41:619-627, 1990.) 'Dioxins' is a generic name given to a series of seventeen specific chlorinated dibenzo-p-dioxins and dibenzofurans in which chlorine is present at one or more of the 2,3,7,8 positions of the molecules. The tetrachlorinated dioxin, 2,3,7,8-tetrachlorodibenzo-p-dioxin (2,3,7,8-TCDD) is believed to be the single most carcinogenic chemical known to science (Healing the Harm: Eliminating the Pollution from Health Care Practices, Health Care Without Harm Campaign Report, 1997; and Huff, 1994.)

Dioxin is dangerous to human health and is a known human carcinogen (International Agency for Research on Cancer (IARC) of the World Health Organizations, United Nations, 1997. National Toxicology Program Board of Scientific Counselors of the National Institute of Environmental Health Sciences, 1997.) The U.S. Environmental Protection Agency (EPA) estimates that the lifetime risk of getting cancer from dioxin exposure is above generally accepted safe levels (Mariani, Jay. Dioxin Fact Sheet, Environmental Law and Justice Clinic, Golden Gate University, San Francisco, 1998.), and the EPA's Dioxin Reassessment has found dioxin 300,000 times more potent as a carcinogen than DDT (the use of which was restricted in the U.S. in 1972) (US EPA. Risk Characterization of Dioxin and Related Compounds; Draft Scientific Reassessment of Dioxin. Washington, D.C.: Bureau of National Affairs. May 3, 1994.); Dioxin has been linked to numerous other illnesses, including endometriosis, immune system impairment, diabetes, neurotoxicity, birth defects (including fetal death), decreased fertility, testicular atrophy and reproductive dysfunction in both women and men (Birnbaum, Linda et al. Developmental Effects of Dioxins and Related Endocrine Disrupting Chemicals. Experimental Toxicology Division, US EPA. Toxicology Letters, p. 743-750, 1995.)

As a result of the attention paid to these issues a number of steps have been taken that aim to reduce the presence of products that contribute to the production and existence of dioxins and furans or at least increase the knowledge of the presence of such products. The 2000 Summer Olympics in Sydney were planned with an effort to minimize the use of chlorinated compounds. In Maine, outdoor burning of chlorinated compounds (notably PVC or vinyl based products) has been banned as these products when subjected to the incomplete combustion. In their effort to reduce the presence of chlorinated compounds, numerous companies and governments have enacted restrictions and material substitution policies aimed at reducing the presence of chlorinated compounds. Large companies such as Proctor and Gamble, Mattel, and the Body Shop have phased out packaging based on chlorinated compounds, specifically PVC based packaging. The Swedish Parliament voted in 1995 to phase out soft PVC and rigid PVC with additives that are already identified as harmful.

This trend toward voluntary reduction or regulatory elimination of chlorinated compounds may pose a threat to the continued use of modacrylic, PAN or chlorofibre/vinyon/PVC-based fibers in fire barrier applications. These types of fibers incorporate chlorinated compounds in their manufacture and the combustion of these fibers, in either normal use, intended use or in incinerative disposal, may result in the formation of chlorinated dioxins and furans. As a result, there is a need to develop products (e.g., mattresses, furniture and other filled articles) that achieve enhanced levels of flammability resistance but that do not rely on the use of fibers or raw materials that use chlorine compounds or by-products in their manufacture and that may threaten the potential release of dioxins and furans into the environment during production or disposal in attaining the enhanced performance levels.

There is work in other fields that seeks to derive benefit from switching to raw materials that have reduced chlorine content profiles in an effort to reduce dioxin production. US Application 2003087414 (Ser. No. 10/109,091) filed Mar. 27, 2002, inventors Reiss and Schenk disclose a disposable diaper and method for making said diaper that is made from "non-chlorine bleached wood pulp" and is further described as being "totally chlorine free". These attributes are cited by the referenced application as being preferred by "many people". This work is limited to diaper and possibly personal/feminine hygiene applications by extensions and does not enter into the uses envisioned by the present invention.

U.S. Application 20030029589 (Ser. No. 09/892,199) filed Jun. 25, 2001 (Altheimer & Jackson) discloses, "Total chlorine free bleaching of Arundo donax pulp", the inventors describe the "elimination of precursor and reduction in chlorine application were found to be effective in bleaching pulp without dioxin formation." This work is limited to composite panels of particleboard for construction applications and does not enter into the uses envisioned by the present invention.

Numerous examples of innovative design approaches to fire barrier design for mattresses and mattress foundations have recently been offered, including the following a. Mason and Hale-Blackstone (20040062912) (Ser. No. 10/262,133) filed Oct. 1, 2002 b. McGuire and Taylor i. (20040097156)(Ser. No. 10/298,990) filed Nov. 18, 2002 ii. (20040102112)(Ser. No. 10/714,370) filed Nov. 14, 2003 iii. (20040106347)(Ser. No. 10/714,132) filed Nov. 14, 2003 c. Mater and Handermann (PCT WO 03-023108) filed Sep. 11, 2002 d. Murphy and Slavik i. (20040060119)(Ser. No. 10/291,879) filed Nov. 8, 2002 ii. (20040060120)( Ser. No. 10/661,292) filed Sep. 12, 2003

All of these works provide for the use of "FR Rayon" or "VISIL" in particular embodiments, however they do not draw a distinction or even make a provision regarding the use of FR viscose or rayon that is Totally Chlorine Free (TCF). Furthermore, as all of these rely on embodiments that specifically provide for the inclusion of modacrylic fibers (which through their manufacture incorporate chlorine atoms bound to the polymer structure), it is not reasonable to one skilled in the art that they would even contemplate the benefits to be derived from use of an ingredient that was an FR rayon or viscose that was specially formulated to be TCF.

SUMMARY OF THE INVENTION

It has been unexpectedly discovered that a mattress, mattress foundation, article of furniture or filled bedding item, composed of a flame retardant fire barrier fabric, comprised entirely of fibers that are inherently flame retardant, totally chlorine free (TCF) rayon or viscose fibers or comprised of blends of inherently flame retardant, TCF rayon or viscose fibers and other fibers or materials that are known not to include chlorine, chlorine compounds or derivatives and that when subjected to combustion cannot release dioxin or furans or similar chlorine by-products, can dramatically reduce flammability of a mattress, mattress set or article of furniture constructed therewith and that such mattress, mattress set or article of furniture that is covered or partially covered with the fabric can meet the stringent new standards for flammability of mattresses, mattress foundations, mattress sets, upholstered furniture or filled bedding article for the residential market set by TB 129, TB 603, TB 604 or their equivalents or successors.

DETAILED DESCRIPTION OF THE INVENTION

Figure 1:
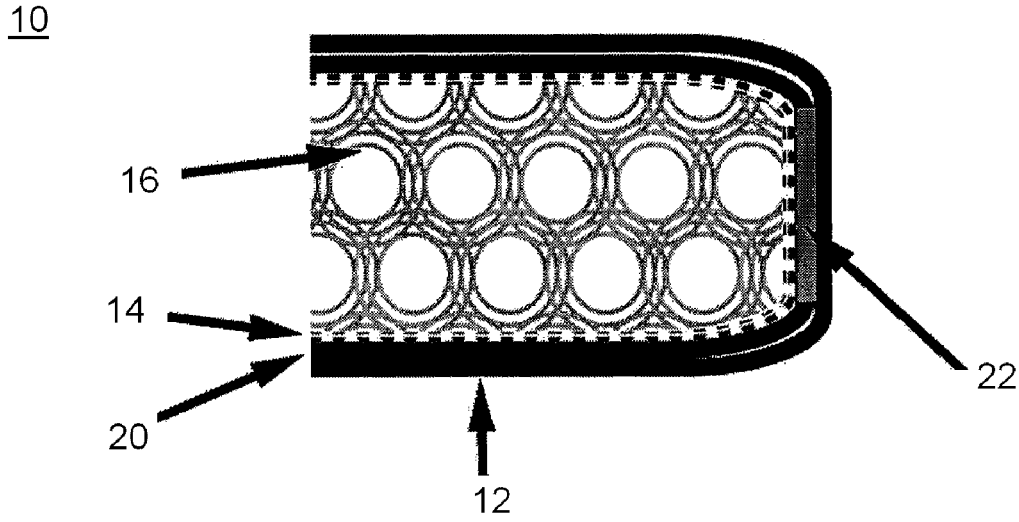
FIG. 1 is a cross-sectional view of an open flame-resistant mattress according to the present invention.

The present invention relates to open-flame resistant mattresses and mattress sets, home furnishing articles and other items filled with cushioning material, fire barrier fabrics that at least partly enclose these mattresses and/or foundations thereof, and yarns composed of chlorine-free rayon fiber. The benefits of the present invention may also accrue to mattresses, mattress foundations and sets of bedding comprised of mattresses and mattress foundations, upholstered furniture articles, filled bedding items such as pillows, mattress pads, and comforters and other items such as wheelchair cushions, healthcare positioners, and transportation seating articles. Chlorine-free fibers, yarns and fabrics according to the present invention produce very small amounts of dioxins and polychlorinated biphenyl (PCB) compounds when burned. In order to facilitate assessment the total effect of exposure to mixtures of the compounds, the other sixteen have been given toxic equivalent factors (TEF) relative to 2,3,7,8-TCDD. Twelve PCB congeners twelve have been assessed to have toxic effects similar to dioxins and have been assigned a TEF. The methodology proposed by the World Health Organization in 1997 has been adopted by the US Environmental Protection Agency and the state of California. The $TEF_{WHO\text{-}97}$ is based on the latest scientific findings available. It includes dioxin-like PCBs (planar PCBs) that contribute to the total TEQ concentration of abiotic and biotic samples, and also facilitates the comparison of environmental measurements to other international databases. WHO toxic equivalent factors ($TEF_{WHO\text{-}97}$) are listed in Table 1.

TABLE 1

Toxic Equivalency Factors ($TEF_{WHO\text{-}97}$) for Dioxins and PCBs

| Congener | TEF |
|---|---|
| PCDDs | |
| 2,3,7,8-TCDD | 1 |
| 1,2,3,7,8-PeCDD | 1 |
| 1,2,3,4,7,8-HxCDD | 0.1 |
| 1,2,3,7,8,9-HxCDD | 0.1 |
| 1,2,3,6,7,8-HxCDD | 0.1 |
| 1,2,3,4,6,7,8-HpCDD | 0.01 |
| 1,2,3,4,6,7,8,9-OCDD | 0.0001 |
| PCDFs | |
| 2,3,7,8-TCDF | 0.1 |
| 1,2,3,7,8-PeCDF | 0.05 |
| 2,3,4,7,8-PeCDF | 0.5 |
| 1,2,3,4,7,8-HxCDF | 0.1 |
| 1,2,3,7,8,9-HxCDF | 0.1 |
| 1,2,3,6,7,8-HxCDF | 0.1 |
| 2,3,4,6,7,8-HxCDF | 0.1 |
| 1,2,3,4,6,7,8-HpCDF | 0.01 |

TABLE 1-continued

Toxic Equivalency Factors ($TEF_{WHO-97}$) for Dioxins and PCBs

| Congener | TEF |
|---|---|
| 1,2,3,4,7,8,9-HpCDF | 0.01 |
| 1,2,3,4,6,7,8,9-OCDF | 0.0001 |
| PCBs | |
| 3,3',4,4'-TCB | 0.0001 |
| 3,4,4',5-TCB | 0.0001 |
| 2,3,3',4,4'-PeCB | 0.0001 |
| 2,3,4,4',5-PeCB | 0.0005 |
| 2,3',4,4',5-PeCB | 0.0001 |
| 2',3,4,4',5-PeCB | 0.0001 |
| 3,3',4,4',5-PeCB | 0.1 |
| 2,3,3',4,4',5-HxCB | 0.0005 |
| 2,3,3',4,4',5'-HxCB | 0.0005 |
| 2,3',4,4',5,5'-HxCB | 0.00001 |
| 3,3',4,4',5,5'-HxCB | 0.01 |
| 2,3,3',4,4',5,5'-HpCB | 0.0001 |

(van Leeuwen, F. X. R., Derivation of toxic equivalency factors (TEFs) for dioxin-like compounds in humans and wildlife. Organohalogen Compounds 34, 237 (1997))

A measure of the cumulative toxicity of these compounds is the total Toxicity Equivalence (TEQ) of the mixture. The TEQ is calculated by multiplying the amount or concentration of each cogener in the sample by its TEF value (U.S. Environmental Protection Agency, Interim procedures for estimating risks associated with exposures to mixtures of chlorinated dibenzo-p-dioxins and dibenzofurans (CCDs and CDFS) EPA/625/3-87/012 (1987)).

In the context of the present invention, "chorine-free" means that when chlorine-free fibers, yarns and fabrics according to the present invention are burned using under the cone calorimeter fire test set up according to an ISO 5660-1 protocol, TEQ of the products of the combustion is less than or equal to 2 nanograms. Analysis of the products may be performed according to EPA Test Method 23. Chlorine-free yarns may be blends of chlorine free rayon fiber with other fibers, such as fiberglass, nylon, polyester, and/or aramid (para- or meta-). The yarns may be in the form of corespun yarns, where the core is composed of fiberglass or aramid fiber and the sheath is composed of Hchlorine-free rayon fiber. Techniques for manufacturing corespun yarns are described in U.S. Pat. No. 4,921,756, to Tolbert.

In the context of the present invention, terms relating to mattresses are defined in conformity with terms as defined by 16 C.F.R. 1632, and as follows:

(a) Mattress means a ticking filled with a resilient material used alone or in combination with other products intended or promoted for sleeping upon.

(1) This definition includes, but is not limited to, adult mattresses, youth mattresses, crib mattresses including portable crib mattresses, bunk bed mattresses, futons, water beds and air mattresses which contain upholstery material between the ticking and the mattress core, and any detachable mattresses used in any item of upholstered furniture such as convertible sofa bed mattresses, corner group mattresses, day bed mattresses, roll-a-way bed mattresses, high risers, and trundle bed mattresses. See Sec. 1632.8 Glossary of terms, for definitions of these items.

(2) This definition excludes sleeping bags, pillows, mattress foundations, liquid and gaseous filled tickings such as water beds and air mattresses which do not contain upholstery material between the ticking and the mattress core, upholstered furniture which does not contain a detachable mattress such as chaise lounges, drop-arm love seats, press-back lounges, push-back sofas, sleep lounges, sofa beds (including jackknife sofa beds), sofa lounges (including glide-outs), studio couches and studio divans (including twin studio divans and studio beds), and juvenile product pads such as car bed pads, carriage pads, basket pads, infant carrier and lounge pads, dressing table pads, stroller pads, crib bumpers, and playpen pads. See Sec. 1632.8 Glossary of terms, for definitions of these items.

(b) Mattress Pad means a thin, flat mat or cushion, and/or ticking filled with resilient material for use on top of a mattress. This definition includes, but is not limited to, absorbent mattress pads, flat decubitus pads, and convoluted foam pads, which are totally enclosed in ticking. This definition excludes convoluted foam pads, which are not totally encased in ticking.

(c) Ticking means the outermost layer of fabric or related material that encloses the core and upholstery materials of a mattress or mattress pad. A mattress ticking may consist of several layers of fabric or related materials quilted together.

(d) Core means the main support system that may be present in a mattress, such as springs, foam, hair block, water bladder, air bladder, or resilient filling.

(e) Upholstery material means all material, either loose or attached, between the mattress or mattress pad ticking and the core of a mattress, if a core is present.

(f) Tape edge (edge) means the seam or border edge of a mattress or mattress pad.

(g) Quilted means stitched with thread or by fusion through the ticking and one or more layers of upholstery material.

(h) Tufted means buttoned or laced through the ticking and upholstery material and/or core, or having the ticking and upholstery material and/or core drawn together at intervals by any other method which produces a series of depressions on the surface." (16CFR1632.2)

(r) Mattress foundation. Consists of any surface such as foam, box springs or other, upon which a mattress is placed to lend it support for use in sleeping upon." (16CFR1632.8)

The present invention also relates to open-flame resistant upholstered furniture articles and filled bedding articles and to fire barrier fabrics that at least partly enclose these articles thereof. In the context of the present invention, terms relating to upholstered furniture and filled bedding articles are defined in conformity with terms as defined by CPSC Proposed Standard for Small Open Flame Ignition of Upholstered Furniture (Revised October 2001), 16 C.F.R. 1632.8, and as follows:

(a) Upholstered Furniture. A unit of interior furnishing that is constructed with a seating area of fabric or other material covering resilient filling material, and is intended for use or may be expected to be used in homes, and is intended or promoted for sitting or reclining upon. Upholstered products include, but are not limited to chairs, sofas, love seats, settees, and benches.

(b) Additional examples of upholstered furniture, may include, but again are not intended to be limited to:

a. Chaise lounge. An upholstered couch chair or a couch with a chair back. It has a permanent backrest, no arms, and sleeps one.

b. Convertible sofa. An upholstered sofa that converts into an adult sized bed. Mattress unfolds out and up from under the seat cushioning.

c. Drop-arm loveseat. When side arms are in vertical position, this piece is a loveseat. The adjustable arms can be lowered to one of four positions for a chaise lounge effect or a single sleeper. The vertical back support always remains upright and stationary.

d. High riser. This is a frame of sofa seating height with two equal size mattresses without a backrest. The frame slides out with the lower bed and rises to form a double or two single beds. Press-back lounges. Longer and wider than conventional sofa beds. When the lounge seat is pressed lightly, it levels off to form, with the seat, a flat sleeping surface. The seat slopes, in the sitting position, for added comfort.

e. Push-back sofa. When pressure is exerted on the back of the sofa, it becomes a bed. When the back is lifted, it becomes a sofa again. Styled in tight or loose cushions.

f. Sleep lounge. Upholstered seating section is mounted on a sturdy frame. May have bolster pillows along the wall as backrests or may have attached headrests.

g. Sofa bed. These are pieces in which the back of the sofa swings down flat with the seat to form the sleeping surface. All upholstered. Some sofa beds have bedding boxes for storage of bedding. There are two types: the one-piece, where the back and seat are upholstered as a unit, supplying an unbroken sleeping surface; and the two-piece, where back and seat are upholstered separately.

h. Sofa lounge—(includes glideouts). Upholstered seating section is mounted on springs and in a special frame that permit it to be pulled out for sleeping. Has upholstered backrest bedding box that is hinged. Glideouts are single sleepers with sloping seats and backrests. Seat pulls out from beneath back and evens up to supply level sleeping surface.

i. Studio couch. Consists of upholstered seating section on upholstered foundation. Many types convert to twin beds.

j. Studio divan. Twin size upholstered seating section with foundation is mounted on metal bed frame. Has no arms or backrest, and sleeps one.

k. Trundle bed. A low bed which is rolled under a larger bed. In some lines, the lower bed springs up to form a double or two single beds as in a high riser.

l. Twin studio divan. Frames which glide out (but not up) and use seat cushions, in addition to upholstered foundation to sleep two. Has neither arms nor back rest.

(c) Examples of filled bedding articles may include, but are not intended to be limited to:

a. Absorbent pads. Pad used on top of mattress. Designed to absorb urine thereby reducing skin irritation, can be one time use.

b. Basket pad. Cushion for use in an infant basket.

c. Car bed. Portable bed used to carry a baby in an automobile.

d. Carriage pad. Cushion to go into a baby carriage.

e. Comforter. A thick bed covering made of two layers of cloth containing a filling material such as feathers, down, sponge rubber, urethane, or fiber.

f. Convoluted foam pad. A bed pad made of foam in an egg-crate configuration not encased in ticking.

g. Crib bumper. Padded cushion, which goes around three or four sides inside a crib to protect the baby. Can also be used in a playpen.

h. Decubitus pad. Designed to prevent or assist in the healing of decubitus ulcers (bed sores).

i. Dressing table pad. Pad to cushion a baby on top of a dressing table.

j. Futon. A flexible mattress generally used on the floor that can be folded or rolled up for storage. It usually consists of resilient material covered by ticking.

k. Infant carrier and lounge pad. Pad to cushion a baby in an infant carrier.

l. Pillow. Cloth bag filled with resilient material such as feathers, down, sponge rubber, urethane, or fiber used as the support for the head of a person.

m. Playpen pad. Cushion used on the bottom of a playpen.

n. Portable crib. Smaller size than a conventional crib. Can usually be converted into a playpen.

o. Sleeping bag. Cloth filled with resilient material such as feathers, down, sponge rubber, urethane, or fiber and tailored in such a manner as to form a complete or partial encapsulation that may be used by a person for sleeping outdoors or in a camp or a tent.

p. Stroller pad. Cushion used in a baby stroller.

FIG. 1 is a cross-sectional view of one embodiment of the invention, a flame-resistant mattress 10, which is composed of ticking cover fabric 12, ticking filling materials 14 and core 16. Core 16 is enclosed by fire barrier fabric in the mattress panel 20 and in the border area 22. In this embodiment, fire barrier fabrics 20 and 22 may be of identical construction or may be specifically designed to address differential ignition challenges and protective requirements, also as fire barrier fabrics 20 and 22 are positioned between ticking cover fabric 12 and ticking filling materials 14, it also encloses the filling materials associated with the ticking, and may be considered a part of the ticking of mattress 10. Alternate embodiments, wherein fire barrier fabrics 20 and 22 are positioned beneath a multilayer ticking composed of a cover fabric and filling materials, are also considered within the scope of the invention. Additionally in mattress designs that are intended to be "one-sided" or "non-flippable", the fire barrier fabric 20 may be placed on the panel surface of the mattress intended for sleeping only. Resistance of mattress 10 to ignition after exposure to an open flame may be determined by full-scale testing in accordance with NFPA 267, 2003 edition, ASTM E 1590, or TB 129. Test protocols of each of these standards are essentially the same, and the entire contents of each test method are incorporated herein by reference. Results of testing a mattress according to the present invention according to such test protocols typically show a maximum heat release rate of less than 250 kW and a total energy release of less than 40 MJ in the first five minutes of the test. In some embodiments of the invention, even better results may be obtained, as follows: maximum heat release rate of less than 100 kW, total heat release of less that 25 MJ in the first ten minutes of the test and weight loss due to combustion of less than 3 pounds in the first ten minutes of the test.

Figure 2:
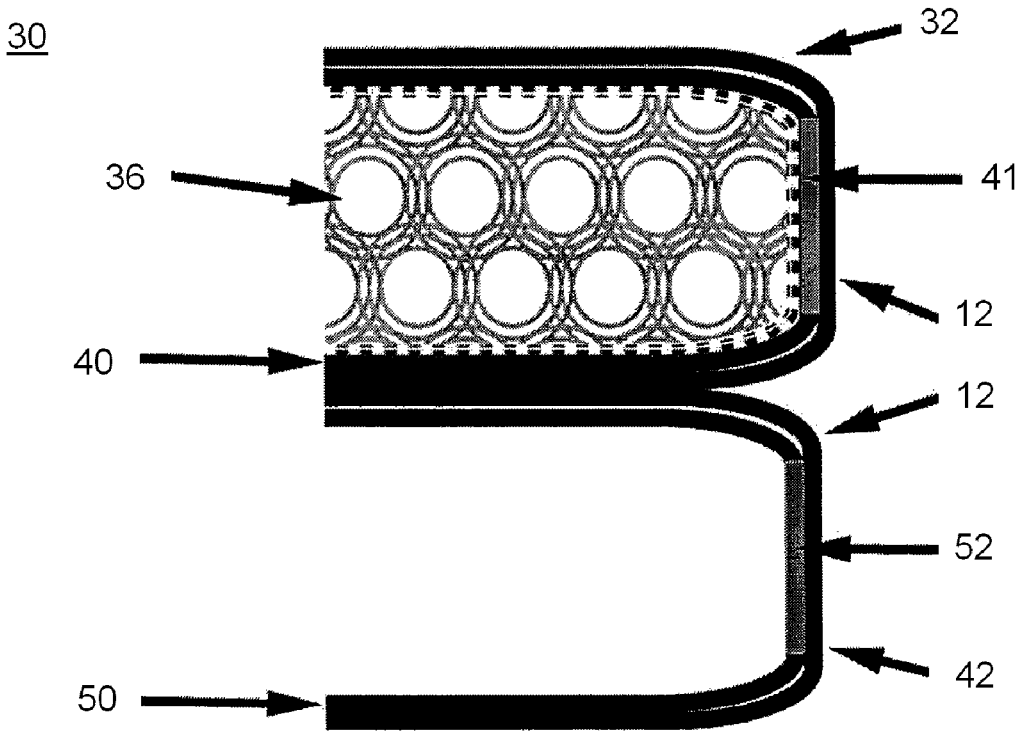
FIG. 2 is a cross-sectional view of an open flame resistant mattress set according to the present invention, including a mattress and foundation, each enclosed by fire barrier fabric.

FIG. 2 shows another embodiment of the invention, a flame resistant mattress set 30, composed of mattress 32 and foundation 42. Mattress core 36 is enclosed by fire barrier fabric in the panel area 40 and the border area 41 and foundation 42 is enclosed by fire barrier fabric in the panel 50 and the border area 52. Fire barrier fabrics 40, 41, 50 and 52 may have different compositions because of the difference in fuel load and flammability of mattress 32 and foundation 42. Additionally in mattress designs that are intended to be "one-sided" or "non-flippable", the fire barrier fabric 20 may be placed on the panel surface of the mattress intended for sleeping only. Furthermore, the fire barrier fabric 50 may only be placed on the panel surface of the foundation 42 that is in contact with the mattress 32. Mattress set 30 typically returns results similar to those above in full-scale open flame testing, that is maximum heat release rate of less than 250 kW and a total energy release of less than 40 MJ in the first five minutes of the test, and in some embodiments, maximum heat release rate of less than 100 kW, total heat release of less that 25 MJ in the first ten minutes of the test and weight loss due to combustion of less than 3 pounds in the first ten minutes of the test.

Figure 3:
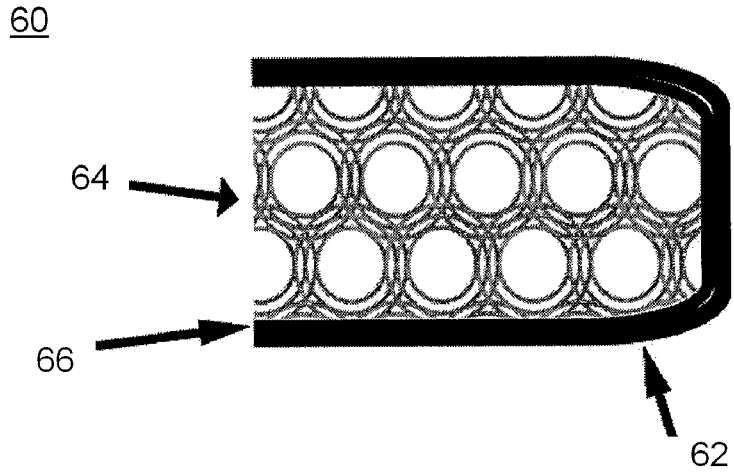
FIG. 3 is a cross-sectional view of an open flame resistant upholstered furniture article according to the present invention.

FIG. 3 shows a cross-sectional view of another embodiment of the invention, a flame resistant upholstered furniture article (a seat cushion) 60, composed of upholstery fabric cover 62, and core 64. Core 64 is enclosed, either completely or partially, by fire barrier fabric 66. Depending on the specific construction of the upholstered furniture article, it may be necessary to place fire barrier 66 directly behind the upholstery fabric cover 62 or fire barrier fabric 66 may alternatively be placed behind filling materials that are attached to the fabric cover 62. Placement of the fire barrier fabric 66 may also be required beneath fabric cover 62 in areas of the upholstered article other than the seating surface, including but not limited to arm supports, upright backs and leg extensions. Upholstered furniture article 60 typically returns results in full-scale open flame testing such as California TB 133, with maximum heat release rate of less than 250 kW and a total energy release of less than 40 MJ in the first five minutes of the test, and in some embodiments, maximum heat release rate of less than 100 kW, total heat release of less that 25 MJ in the first ten minutes of the test and weight loss due to combustion of less than 3 pounds in the first ten minutes of the test.

Figure 4:
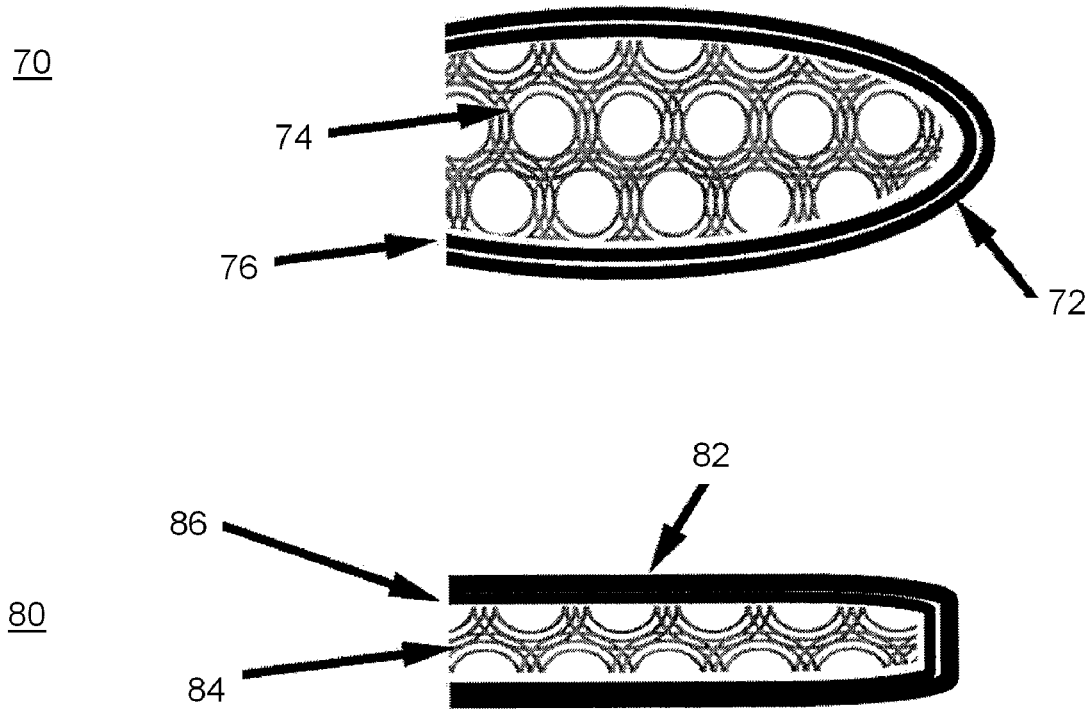
FIG. 4 is a cross-sectional view of open flame-resistant filled bedding items according to the present invention each enclosed by a fire barrier fabric.

FIG. 4 shows a cross-sectional view of two more embodiments of the invention, specifically a flame resistant pillow 70 and a flame resistant mattress pad 80. Flame resistant pillow 70 is composed of a pillow ticking fabric 72 and resilient filling material 74. Resilient filling material 74 is enclosed, either completely or partially by fire barrier 76. Flame resistant mattress pad 80 is composed of a ticking fabric 82 and a resilient filling material 84. Resilient filling material 84 is enclosed, either completely or partially by fire barrier 86. In alternative embodiments, the fire barrier fabrics 76 and 86 may even be of such a textile construction to serve as a replacement in the entirety of the ticking material. Under full-scale open flame testing, such as the proposed California TB 604, these embodiments would be of a sufficient design nature to earn a passing or compliant rating.

A fire barrier fabric according to the present invention typically functions to protect a mattress, a mattress set (comprised of a mattress and foundation), an upholstered furniture article or a filled bedding item from fire by forming a char when exposed to an ignition source. In the context of the present invention, the term 'char' is defined as a residue formed from material that has been exposed to heat and/or flame, and which is no longer flammable. The char may be formed from materials that have been incompletely burned and extinguished, or from materials that do not react chemically under conditions found in a fire, and so, are not flammable, such as fiberglass. The char may also possess mechanical strength and integrity and so can act as a physical barrier to prevent flames from contacting highly combustible interior fill components of mattresses and mattress foundations. In those cases where the char contributing element does not possess mechanical strength to maintain the integrity of the char layer, it is conceived in the present invention that blending of other fibers, that do possess mechanical strength with the charring fibers is desirable, so long as the blending candidates are consistent with the desire of the present invention to not be comprised of chlorine or chlorine by-product based compounds. In addition, it is desirable that the char should not melt, drip or shrink away from the ignition source, or display significant after-flame, or support these reactions at a level sufficient to cause ignition of adjacent materials.

Accordingly, the fire barrier is composed of a chlorine-free, flame retardant rayon fiber. Such fiber is not widely commercially available at the present time. It is contemplated by the present invention that manufacturers of fibers that meet the flammability performance requirements of the pending regulatory changes regarding fire resistant performance, but that presently incorporate chlorine in the polymer structure or use chlorine or chlorine compounds in the manufacturing process will seek to re-engineer their product, if feasible, to eliminate the potential dioxin/furan release and creation caused by these elements. For example, the production of FR rayon or viscose fiber has traditionally been made without concern for chlorine content as it relates to dioxin/furan production. Conversion to a totally chlorine free manufacturing process would result in the creation of a fiber whose inclusion is contemplated by the present invention.

Chlorine-free flame retardant rayon fiber may be used by itself or it may be combined with other fibers or materials, selected from those that do not contain chlorine atoms bound to the polymer structure and that do not utilize chlorine in the processing or manufacture of the fiber or material. The following fibers are exemplary: aramids, including para-aramids (poly(p-phenylene terephthalamide), e.g., KEVLAR® (Dupont Corporation) and TWARON® (Teijin Twaron BV) and meta-aramids (poly(m-phenylene isophthalamide), such as Nomexe (Dupont Corporation); fiberglass; melamines such as BASOFIL® (BASF); poly-benzimidazole (PBI) (Celanese Acetate A.G); novoloids, such as KYNOL® (American Kynol, Inc); carbon fibers, wool and FR-treated cotton where the flame resistant treatment is achieved in a totally chlorine free (TCF) manner. It should be noted that these fibers are merely exemplary, and other fire-retardant fibers that form a char, including fibers that are developed in the future may be used. Additionally, certain proprietary fibers that release extinguishing/oxygen-depriving elements such as when exposed to an ignition source may be used, so long as they are free of chlorine or chlorine by-product in their manufacture or disposal. This chemical reaction may assist in snuffing out small flames that may occur on adjacent, non-FR components such as the mattress covering fabric or ticking. Blends that include at least one fire-retardant fiber that form a char may also be used. The blends may include one or more structure-providing char-forming fire-retardant fibers, FR-treated fibers, such as FR-treated polyester, and non-FR fibers. In particular, the fire barrier layer may be composed of a blend of fiberglass and totally chlorine free, inherently flame retardant viscose or rayon fibers or yarns, of para-aramid and totally chlorine free, inherently flame retardant viscose or rayon fibers or yarns, of FR viscose fibers and jute, hemp, ramie, flax and/or cotton fibers, or of fiberglass, FR viscose, polyester and nylon fibers. Aramid-totally chlorine free, inherently flame retardant viscose or rayon blends typically contain 5-25% para-aramid fiber and 75-95% totally chlorine free, inherently flame retardant viscose or rayon fibers. Non-flame-resistant polyester and/or nylon may be used as a carrier fiber for manufacturing fabrics or lending strength to low strength fibers for the purpose of fashioning the fiber into a usable yarn or for serving as a binder during certain non-woven manufacturing processes by the application of heat or chemistry to the fabrication process. Such yarns and derived fabrics may contain as little as 5% of a polyester or nylon fiber, and up to 50% of that fiber.

The fire barrier fabric component of the composite items contemplated by the present invention may be constructed by known techniques, including, for example, knitting, weaving, or non-wovens textile fabrication approaches. The present invention contemplates that non-woven approaches are those textile structures made directly from fiber rather than yarn. These fabrics are normally made from extruded continuous filaments or from fiber webs or batts strengthened by bonding using various techniques: these include adhesive bonding, mechanical interlocking by needling (a.k.a., needlepunching) or fluid jet entanglement, thermal bonding and stitch bonding. In the context of the present invention, fabrics that are classified as nonwoven include wet-laid fabrics that contain wood pulp, in which the boundary with paper is not clear; stitch-bonded fabrics, which contain some yarn for bonding purposes; and needled fabrics containing reinforcing fabric or scrim. In addition, the fire barrier fabric may have a second fabric layer bonded thereto. Bonding of the second layer may be accomplished by needle punching, or any other suitable construction. Finally, the fire barrier fabric may be stitched to the mattress ticking or upholstery fabric, if desired.

Specific design parameters, such as weight of the fire barrier fabric, blend levels of fibers for each of the components and choice of textile construction, are not critical. Weight of the fire barrier typically ranges between 0.25 oz and 30 oz per square yard, and preferably is about 5.0 oz per square yard, in an effort to appropriately address the differing burning characteristics that may be present in the vertical and horizontal surfaces of the mattress and foundation. Since the protection levels required for different mattress, furniture and filled bedding article constructions are based on the fuel load they represent, a range of configurations and combinations of elements that make up fire barrier fabrics, mattresses, mattress foundations, and mattress sets, articles of upholstered furniture and filled bedding articles of the present invention is envisioned. A relatively low fabric weight containing fibers that do not perform at the highest level and therefore would not be at the high end of the cost spectrum may be appropriate for an inexpensive item or a composite article representing a minimal fuel load. A higher finished fabric weight including very high-performing fibers at a higher cost may be appropriate protection for particularly challenging constructions, such as an extra-thick, premium pillow-top constructions, overfilled with combustible materials in the quest for luxury and comfort or upholstery articles that use particularly highly flammable covering or upholstery fabrics, such as poly-olefin. A particular composition appropriate for given circumstances is typically determined by full-scale testing of a composite incorporating a proposed design. Ancillary considerations for design of a fire barrier fabric for use in composites of the present invention include cost factors associated with raw material components and assembly methodologies, ability to integrate the fabric into existing production processes for mattress manufacturers, potential health hazard issues associate with the chemical makeup of raw materials used in the design and manufacture of the fire barrier fabric, durability of the fabric itself and of the mattress or mattress set once the fabric is incorporated into the finished mattress design, and the impact of the product on the comfort elements that are critical to market acceptance of the mattress or sleep surface.

As envisioned by the present invention, the fire barrier fabric can be of particularly lightweight nature to achieve the desired outcomes disclosed.

It is not necessary that fire barrier fabrics according to the present invention be finished, that is bleached, dyed, scoured, heat-set, pre-shrunk, as these steps typically add cost to the finished product without any additional aesthetic benefit, as the fabric is typically concealed from view. Therefore, the greige state of the fabric is typically sufficient. However, if finishing were desired, such would not materially affect performance of the fabric. Hand of the fire barrier fabric typically does not compromise comfort elements of the sleep surface. Mattress manufacturers may employ objective measures of this using a process referred to as pressure mapping.

Furthermore, certain applications, such as healthcare settings, may benefit from the inclusion or application of chemical treatments to the fire barrier fabric that promote anti-bacterial, anti-microbial, anti-fungal, anti-odor, anti-static, stain resistance or similar performance. The present invention contemplates such eventualities, for both demonstrable benefits and marketing advantages that they may accrue to the composite and the fiber selection flexibility would be intended to promote such modification where necessary, so long as the selected chemical treatments remain consistent with the intent of the invention to exclude use of those compounds fibers that are chlorine based or derivatives of chlorine compounds.

A typical design approach for mattresses is to localize comfort elements, such as polyurethane foams and battings, in the sleep surface areas (panels), with a minimum of fabric in the borders or sides. Accordingly, the fire barrier fabric according to the present invention at least partially encloses the core of the mattress, and the core may be fully enclosed, if desired, as flame retardant performance may be achieved without loft or thickness being so high as to hinder the ability of the mattress manufacturer to completely encapsulate the fuel load with the fire barrier fabric. In addition, the weight and composition of the fire barrier may be varied in order to address the burning and combustion challenges presented by a variety of mattress and mattress foundation designs. Fire barrier fabric having different compositions may be used to cover different areas of the mattress or mattress foundation. For example, lighter weight and lower cost versions may be used as barriers for the horizontal surface area that is the panel or mattress top, while heavier weight and higher cost versions may be used to protect vertical surfaces, that is the borders or sides of the mattress for foundation. In general, design and financial resources for raw materials and assembly costs may be targeted to areas of the mattress and foundation that require a greater investment for fire protection. Individual pieces of the fire barrier fabric for the panel and/or border may be joined at the tape edge of the mattress with sewing thread specifically designed to withstand ignition, typically para-aramid or fiberglass sewing thread.

The fire barrier fabric may be placed under or disposed beneath a mattress ticking. The fire barrier layer may be placed in the outermost internal position, that is, in contact with the exterior decorative ticking or it may be placed in a position separated from the exterior decorative ticking by a layer or layers of concealing material that does not possess particularly volatile flammability performance. For example, if the fire barrier is comprised of para-aramid fibers or fiber containing a color that requires concealment from view of the outside of the mattress, a batting layer composed of fibers having a white color may be placed on the outside of fire barrier fabric layer. The fire barrier fabric may be simply placed adjacent to or in contact with the ticking using flame-retardant thread, or it may be bonded or attached to it. In particular, the fire barrier fabric may be conveniently quilted to the ticking, as mattresses for the residential market typically have decorative patterns stitched in the cover fabric or filling materials. This can be of benefit to mattress manufacturers, and only one feed position on quilting equipment may be required to add the fire barrier fabric during the quilting operation. Fire-retardant thread composed of FR fibers such as fiberglass or para-aramid may be used in the quilting operation.

The fire barrier fabric may also be designed to address variable flammability of decorative exterior cover and filling materials by including fibers that provide structure to the char formed therefrom, as the stitching of the quilt design may compress the barrier elements, resulting in a point of weakness. Therefore, fibers that yield a char having structural integrity may be used to bridge this area of compression and promote survival of the flame barrier and thermal protection.

Flame-retardant mattresses and mattress sets according to the present invention typically perform favorably when tested under the full-scale protocols set forth in applicable fire resistance codes, such as NFPA 701 and California Technical Bulletin #117, and even under the more demanding protocols set forth in California Technical Bulletin #129, NFPA 101 Life Safety Code 2000, NFPA 267, ASTM E-1590, and UL 1895. That is, a mattress or mattress set according to the present invention typically has a maximum heat release of less than 250 kW and a total energy release of less that 40 MJ in the first five minutes of the TB 129 test, or its equivalents. In some embodiments, the mattress or mattress set may earn a 'pass' rating when tested under the same protocol, having a weight loss due to combustion of less than 3 pounds in the first ten minutes of the test, maximum heat release of less than 100 kW and total heat release of less that 25 MJ in the first ten minutes of the test.

Flame-retardant upholstered furniture articles according to the present invention typically perform favorably when tested under the full-scale protocols set forth in applicable fire resistance codes, such as California Technical Bulletin #133. That is, an upholstered furniture article according to the present invention typically has a maximum heat release of less than 250 kW and a total energy release of less that 40 MJ in the first five minutes of the TB 133 test, or its equivalents. In some embodiments, the article may earn a 'pass' rating when tested under the same protocol, having a weight loss due to combustion of less than 3 pounds in the first ten minutes of the test, maximum heat release of less than 100 kW and total heat release of less that 25 MJ in the first ten minutes of the test.

EXAMPLES

Example 1

Fabric Manufacture

Knitted fire barrier fabrics were manufactured that reflected that traditional approach to fire barrier design using a fiber (modacrylic) known to have links to chlorine production and thus believed to cause the production of dioxins and furans during combustive activity, and that reflected the present invention by replacing the modacrylic content with a blend of totally chlorine free (TCF), inherently flame retardant viscose fiber obtained from Sateri Oy of Valkeakoski, Finland (FR Rayon Staple fiber) and Nylon—both of which were not believed to cause the production of dioxins and furans during combustive activity or production. The construction of these fabrics was a 1×1 rib knit using circular knitting technology. The composition of these fabric alternatives were as follows:

| Item # | Weight | Construction | Composition |
|---|---|---|---|
| BK 1000B-XX #150101027 | 7.1 oz/lin yd | 1 × 1 Rib Knit | Blend of Fiberglass Yarn, Modacrylic Yarn and Polyester Yarn |
| BK 3822 #051159003 | 7.0 oz/lin yd | 1 × 1 Rib Knit | Blend of Fiberglass Yarn, blended TCF viscose and nylon Yarn and Polyester Yarn |

The substitution of yarn was not shown to have any detrimental affect on the manufacturing process.

Example 2

Results of Thermal Decomposition of Fabric

Knitted fire barrier fabrics as disclosed in Example 1 above, were submitted for independent laboratory testing under the ISO 5660-1 test standard. Twenty specimens of sizes 100×100 $mm^2$ were cut from samples of the knit items identified as Style 1000B-XX and Style 3822 and the samples were burned in the cone calorimeter and the chemical compounds generated were analyzed by measuring their abundances in the exhaust duct of the measuring system. The irradiation level of the cone radiator was 50 $kW/m^2$ and the duration of each test was 5 minutes.

The results of FTIR (Fourier transform infrared) spectrometry analysis on the selected fabric samples returned the following values:

| | Analysis | Peak Concentration (ppm)/Yield (grams of substance per kg fabric burned) | |
|---|---|---|---|
| Compound | Technique | Style 3822 | Style 1000B-XX |
| Hydrogen Chloride (HCl) | FTIR | 2 | 406 |
| Hydrogen Bromide (HBr) | FTIR | 2 | 0 |
| Hydrogen Cyanide (HCN) | FTIR | 1 | 66 |
| Ammonia ($NH_4$) | FTIR | 1 | 17 |
| Sulfur Dioxide ($SO_2$) | FTIR | 2 | 9 |
| Acrolein ($C_3H_4O$) | FTIR | 5 | 10 |

| | Amount of chlorinated dioxins and furans (ng I-TEQ) | |
|---|---|---|
| Compound | Style 3822 | Style 1000B-XX |
| 2,3,7,8-TCDD | <0.0005 | 0.230 |
| 1,2,3,7,8-PeCDD | <0.0005 | 0.100 |
| 2,3,7,8,-TCDF | <0.001 | 1.300 |
| 1,2,3,7,8-PeCDF | <0.0005 | 0.051 |
| 1,2,3,4,7,8-HxCDF | <0.0005 | 0.160 |

The laboratory assessment of the relative performance of the fabrics drew the following conclusion: " . . . tests with Fabric Style 1000B-XX revealed considerable amounts of several dioxin and furan cogeners."

Example 3

Full-Scale Open Flame Testing

Procedure

Mattresses including fire barrier fabrics according to the present invention were fabricated, and tested in accordance with TB 129. All instrumentation was zeroed, and calibrated prior to testing. The test specimen, after conditioning to 73° F. and 50% R.H., was placed on a steel frame, on a load cell platform along the far side of the test room (Configuration A). The specified propane burner was placed centrally and parallel to the bottom horizontal surface of the mattress 1 inch from the vertical side panel of the mattress. The computer data acquisition system was started, and then the burner was ignited and allowed to burn for 180 seconds. The test was continued until either all combustion ceased, or one hour passed.

Data recorded included: room smoke opacity; weight loss; smoke release rate (SRR); total smoke release (TSR); carbon monoxide concentration; heat release rate (HRR); total heat release (THR); ceiling temperature above specimen; and temperature at 4 feet above floor, 3 feet out from center of specimen.

The following tests were conducted and the performed as disclosed below:

Three mattresses of Design S2 were built using the Style 1000B-XX Fire Barrier

| Unit # | Peak HRR | Total Heat Release 1st 10 Min | Weight Loss in 1st 10 Min | Outcome |
|---|---|---|---|---|
| 16809-115551 | 42.90 kW | 7.40 MJ | 0.3 lb | Meets Requirement of TB 129 |
| 16809-115552 | 40.00 kW | 6.60 MJ | 0.3 lb | Meets Requirement of TB 129 |
| 16809-115553 | 49.60 kW | 7.50 MJ | 0.3 lb | Meets Requirement of TB 129 |

Two mattresses of Design S2 were built using the Style 3822 Fire Barrier

| Unit # | Peak HRR | Total Heat Release 1st 10 Min | Weight Loss in 1st 10 Min | Outcome |
|---|---|---|---|---|
| 16809-115554 | 54.10 kW | 7.90 MJ | 0.7 lb | Meets Requirement of TB 129 |
| 16809-115555 | 55.20 kW | 13.00 MJ | 0.8 lb | Meets Requirement of TB 129 |

-continued

Two mattresses of Design S2 were built using the Style 3822 Fire Barrier

| Unit # | Peak HRR | Total Heat Release 1st 10 Min | Weight Loss in 1st 10 Min | Outcome |
|---|---|---|---|---|
| 16809-115556 | 47.80 kW | 9.90 MJ | 0.5 lb | Meets Requirement of TB 129 |

Mattresses including a fire barrier fabric composed of a blend of fiberglass, nylon, polyester and TCF, inherently flame retardant viscose fibers earned passing ratings under the TB 129 protocol.

A fire barrier fabric according to the present invention may also be used in other applications where it is desired to protect an upholstered or otherwise padded or filled article from heat of flames. Examples of applications include upholstered furniture, filled bedding articles and transportation and health care seating systems, where filling materials may be partly or completely enclosed by a fire barrier fabric according to the invention. Filled bedding articles may include, but are not intended to be limited to, pillows, mattress pads, and comforters, regardless of filling material. Transportation seating systems include seats for airplanes, trains and buses and health care seating systems include seats or cushions for wheelchairs. Another example is protective apparel, such as firefighter turnout gear, where the filling materials may be covered by a fire barrier fabric. Performance of upholstered materials may be evaluated using the protocols set forth in California Technical Bulletins 117 and 133. Flammability performance assessment of filled bedding articles is likely to be made under the provisions of California Technical Bulletin #604, or California Technical Bulletin #117.

The invention claimed is:

1. A totally chlorine-free, flame retardant yarn comprising totally chlorine-free flame retardant rayon fiber.

2. A totally chlorine-free, flame retardant yarn according to claim 1, in the form of a corespun yarn.

3. A totally chlorine-free, flame retardant yarn according to claim 2, wherein the corespun yarn has a continuous filament core comprising fiberglass and a sheath of staple fibers surrounding the core, and the staple fibers comprise the totally chlorine free flame retardant rayon fiber.

4. A totally chlorine-free, flame retardant yarn according to claim 2, wherein the corespun yarn has a continuous filament core comprising aramid fiber and a sheath of staple fibers surrounding the core, and the staple fibers comprise the totally chlorine free flame retardant rayon fiber.

5. A fire barrier fabric comprising a yarn according to claim 1.

* * * * *